United States Patent [19]

Austin

[11] 3,937,164

[45] Feb. 10, 1976

[54] HIGH SPEED WATER CRAFT APPARATUS

[75] Inventor: Thomas M. Austin, Fargo, N. Dak.

[73] Assignee: Austin Aeromarine, Inc., Fargo, N. Dak.

[22] Filed: Nov. 20, 1974

[21] Appl. No.: 525,406

[52] U.S. Cl. ..... 114/66.5 R; 114/67 A
[51] Int. Cl.[2] ..... B63B 1/20; B63B 1/38
[58] Field of Search ..... 114/66.5 R, 61, 67 A

[56] References Cited

UNITED STATES PATENTS

| | | | |
|---|---|---|---|
| 2,666,406 | 1/1954 | Babcock | 114/61 |
| 3,117,545 | 1/1964 | Warner | 114/67 A |
| 3,186,370 | 6/1965 | Hoyle | 114/66.5 R |
| 3,702,598 | 11/1972 | Szptyman | 114/66.5 R |

*Primary Examiner*—Trygve M. Blix
*Assistant Examiner*—Gregory W. O'Connor

[57] ABSTRACT

A high-speed water craft having twin streamlined hulls and a centrally located aerodynamic body structure. The aerodynamic body structure bottom surface has an S-shaped longitudinal profile which is positioned above the surface of the water and which provides a venturi chamber beneath the body structure. Aerodynamic forces created by air passing through the venturi chamber act to raise the craft out of the water and also produce stabilizing aerodynamic forces as the craft is propelled forward at high speeds. A streamlined hydrodynamic power pod is provided beneath the body structure to create an improved hydrodynamic environment which increases the efficiency of power means utilized to propel the craft.

6 Claims, 3 Drawing Figures

HIGH SPEED WATER CRAFT APPARATUS

BACKGROUND OF THE INVENTION

1. Field of the Invention

High speed water craft apparatus including a twin hull design which supports an aerodynamically designed body structure for creating a venturi chamber beneath the craft. A hydrodynamic power pod is provided for improving the hydrodynamic environment in which the craft power means is operating.

2. Description of the Prior Art

The speed and stability of water craft are generally limited by the intrinsic nature of the environment in which they operate. Most small water craft are intended to be propelled through water by means of power supplied by an outboard motor, an inboard motor or a jet type propulsion system. Because of the weight of the craft, a large portion of the craft remains immersed in the water while the craft is being propelled forward. Because of the scientific laws of hydrodynamics, this immersion of the craft in the water produces hydrodynamic drag and limits the maximum operating speed of such craft.

Various attempts have been made to increase the speed of a small water craft by providing means for raising the front portion of the craft out of the water, thereby reducing the amount of the craft hull which remains wetted and which thus causes hydrodynamic drag. While various hull designs have been created which allow the water craft to plane in the water and thus to raise the front portion of the water craft above the water surface, e.g., V-hull boats and tunnel boats, such craft have proven to be generally unstable because of the aerodynamic forces which act on the craft at high speeds once the front portion of the craft is elevated. Thus, the same hull design which acts to raise the front portion of the craft above the water surface also adversely affects the stability of the craft which results from the aerodynamic forces acting upon it at high speeds. These forces take several forms including a tendency for the front end of the craft to pitch up adversely if the craft encounters rough water or if a gust of wind acts upon the craft, or the cyclic buffeting of the craft due to variations in the hydrodynamic and aerodynamic forces acting on the up-raised bow of the craft. Such forces can result in loss of control of the craft, a flip-over of the craft or continuous and possibly damaging stressing of the craft.

In addition to the existence of stability problems with presently available high-speed boats, the various hull designs which have been created to increase the speed of the craft have failed to completely remedy adverse effects which the craft hull have on the hydrodynamic operating environment of the craft power means. For instance, in the case of an outboard motor which is used on a recreational water craft, the submerged portion of the craft hull may cause adverse conditions to exist in the water environment which surrounds the prop of the motor and thus produce cavitation and other hydrodynamically retarding forces upon the motor prop. These deficiencies in craft hull design may tend to limit the ultimate operating speed of the craft.

SUMMARY

The present invention incorporates an improved water craft hull and power pod design for increasing the stability and maximum operating speed of water craft. The design includes a pair of streamlined hulls interconnected by an aerodynamic body structure. It is the purpose of the streamlined hulls to create a planing force which tends to raise the craft out of the water to reduce the hydrodynamic drag upon it. The aerodynamic body structure has an S-shaped bottom surface which creates a venturi chamber beneath a portion of the craft. The aerodynamic forces created by this venturi chamber tend to form an air cushion for partially raising the craft out of the water. The aerodynamic forces and the air cushion provide neutral or positive stability to the craft which makes it more controllable than present boat designs.

A hydrodynamic power pod is incorporated into the bottom structure of the recreational water craft to produce an advantageous hydrodynamic environment in the area in which the craft power means is operating. The power pod has a streamlined shape which is immersed in the water and tends to compress and streamline the flow of water beneath the craft before it impinges upon the submerged point of operation of the power means. This results in an improved operating environment for the power source, be it an outboard motor prop, an inboard motor water screw or a propelling jet.

DETAILED DESCRIPTION OF THE PREFERRED EMBODIMENT

Figure 1:
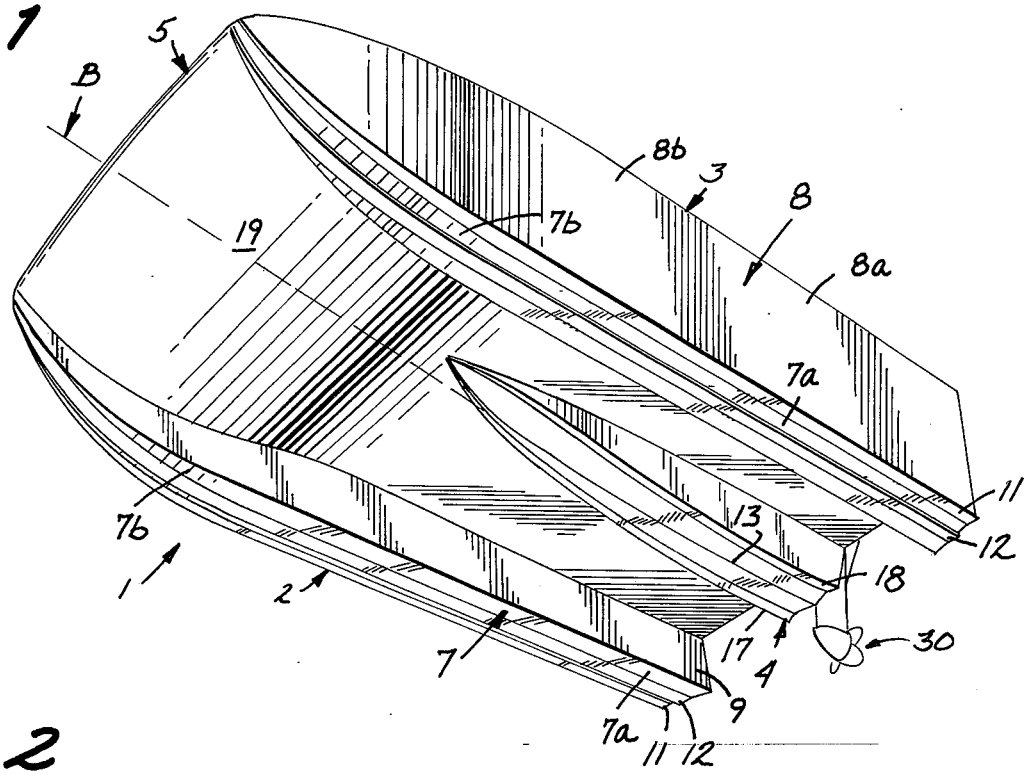
FIG. 1. is a perspective view showing the under side of the water craft hull and power pod.
Figure 2:
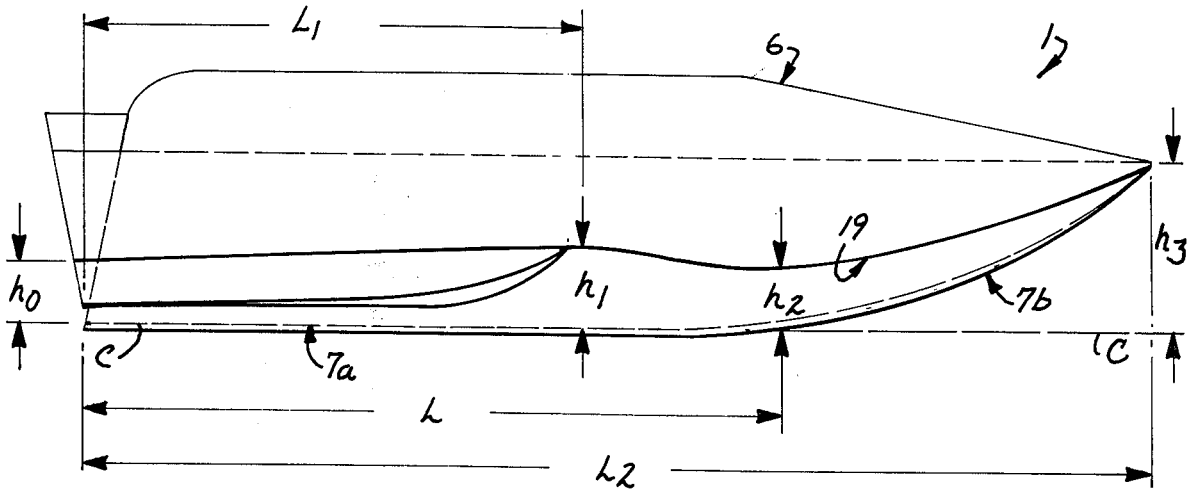
FIG. 2 is a diagrammatic view in side elevation showing the pertinent dimensions of the S-shaped hull.
Figure 3:
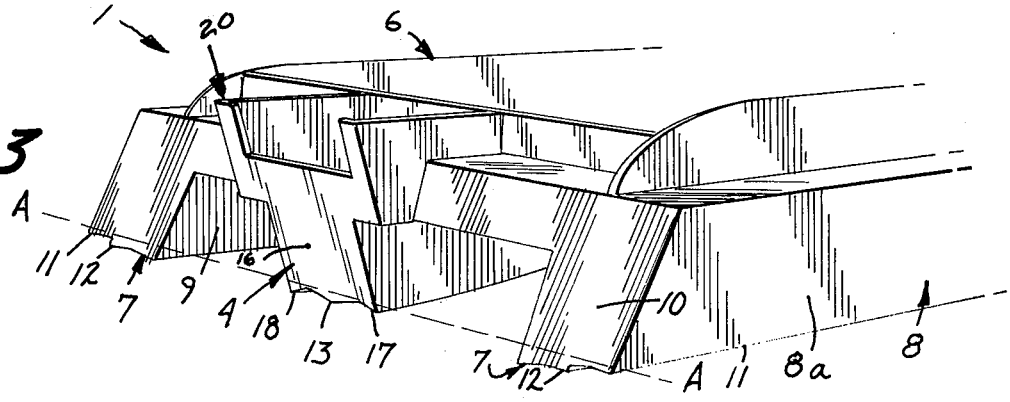
FIG. 3 is a perspective view showing the aft portion of the water craft hull and power pod.

Referring to FIGS. 1–3, wherein like numerals refer to like structural elements, the present invention is a water craft 1 which comprises a pair of streamlined hulls 2 and 3 which are interconnected by an aerodynamic body structure 5. A hydrodynamic power pod 4 is positioned along the centerline of the craft 1 to produce an improved hydrodynamic operating environment for the craft power source, represented in FIG. 1 by motor prop 20. A superstructure 6 is provided on the top portion of the craft 1 for purposes of enclosing a passenger or cargo compartment or of producing streamlined shelter means for the interior of the craft. The craft is laterally symmetrical about a longitudinal centerline B (see FIG. 1) which laterally divides the craft. It should be noted that in this description of the preferred embodiment, detailed description is made of only one side of the craft whereas the description actually applies to each of the symmetrically disposed sides of the craft.

Streamlined side hulls 2 and 3 are disposed on opposite sides of the craft 1. Each of hulls 2 and 3 consists of a bottom running surface 7, an outer side surface 8, an inner side surface 9 and an aft surface 10. While the preferred embodiment shown in FIG. 2 shows the aft surface 10 to slope outwardly at the base of the craft, the particular shape and orientation of the hull aft surface 10 is not critical to the operation of this invention.

To provide a streamlined hull which produces hydrodynamic planing forces that tend to raise the front portion of the craft 1 above the water surface, side hulls 2 and 3 have a generally streamlined shape. In particular, the outer surface 8 of each hull has a generally planar aft portion 8*a* and a curved forward portion 8*b* which curves inwardly toward the centerline B of the craft at the craft bow end. This produces a streamlined frontal profile which reduces the aerodynamic drag on the craft 1. The top portion of hull side surface 8 adjoins the superstructure 6 which is also streamlined to reduce aerodynamic drag. The running surface 7 of each hull has a generally planer aft portion 7*a* and a curved forward portion 7*b* which curves upwardly toward body structure 5 at the bow of craft 1. In addition, forward portion 7*b* is tapered to a very narrow width at the bow tip. This reduces the profile drag of the hulls 2 and 3. In the preferred embodiment shown in FIG. 2 the length of the planar hull bottom portion 7*a* is slightly longer than the curved portion 7*b*. However, other proportions of planar and curved segments of both of surfaces 7 and 8 may be utilized where appropriate. In the preferred embodiment shown in FIGS. 1–3, the planar portion 7*b* of the hull running surfaces slant inwardly and downwardly from the outside lateral edge where they abut outside side surfaces 8. This provides a "cutting" edge to the hull which tends to increase the lateral stability of the craft 1. The oblique orientation of surface 7 with respect to hull side surfaces 8 and 9 is shown in detail in FIG. 3.

When craft 1 is running at high speed, it will hydroplane on the bottom surface of hulls 2 and 3. Depending on the speed of the craft 1, a forward portion of each of said hulls will ride above the water surface and the remaining aft portion will be submerged. The Applicant has found that approximately the aft two feet of each of hull bottom surfaces 7 remain submerged at high speed running (for a 17 foot length craft).

As is shown in detail in FIGS. 1 and 3, a pair of chines 11 and 12, is positioned on each of hull running surfaces 7. In the preferred embodiment, each of chines 11 and 12 has a triangular cross section with one edge generally perpendicular to hull bottom surface 7. This extended surface "cuts" the water and provides lateral stability to the craft 1. In addition, chines 11 and 12 act to streamline the water flow along the hull. In the preferred embodiment shown in FIGS. 1–3, chine 11 is located at the outer edge of running surface 7 and chine 12 is located generally along the center line of the running surface 7. Each of chines 11 and 12 extend from the hull aft surface 10 to the forward edge of the running surface 7.

Positioned between hulls 2 and 3 is aerodynamic body structure 5. Aerodynamic body structure 5 has a bottom surface 19 which has an S-shaped longitudinal profile. The top portion of structure 5 may have various designs to facilitate the carrying of passengers and cargo. In the preferred embodiment, the longitudinal profile of bottom surface 19 is laterally constant across its width extending between hulls 2 and 3. It is the purpose of S-shaped bottom surface 19 to provide a venturi chamber beneath craft 1 which produces advantageous aerodynamic forces as will be described in detail later. The longitudinal profile of the bottom surface 19 can best be described with reference to a plane line A—A which extends across the width of the craft 1 at the aft end and a longitudinal base plane C—C which passes through the intersection of planar hull bottom surfaces 7*a* and the planar outer side surfaces 8*a*. Plane C—C is shown in edge view in FIG. 2. Plane line A—A extends between the lowest aft point on each of hull outer side surfaces 8, exclusive of the depth of chine 11. The length of plane line A—A is referred to as the "beam" or width of the craft 1. When the craft 1 is operating at high speeds (e.g. 40–60 miles per hour) the plane line A—A is generally coincident with the mean water surface with only the inwardly slanting aft portions 7*a* of the hull running surfaces 7 remaining submerged.

As is shown in FIG. 2, the S-shape profile of bottom surface 19 results in a varying height between the base plane C—C and the surface 19. This distance is the largest (*h*3) at the forward tip of the craft 1 and the smallest at the aft edge of surface 19 (*h*0). In between these extreme points, the distance of surface 19 from plane C—C varies to form a restricted throat area (*h*2) located forward of an enlarged expansion opening (*h*1). The exact profile of surface 19 can be described as a tabulation of heights, each designated by the letter *h*, measured perpendicular to the plane C—C and each corresponding to a length L measured from base line A—A. Such a tabulation for a craft 1 having a maximum length of 17 feet would be:

| L | h |
|---|---|
| 0 | 12" |
| 8' | 15" |
| 12½' | 12½" |
| 17' | 24" |

This profile forms a venturi-type chamber beneath body 5 as will be described in detail later. It should be noted that other detailed profile tabulations may also be utilized for the present invention if they provide a similar venturi-chamber with suitable lifting and stabilizing effects on craft 1. The Applicant has found that the distance *h*0 between plane C—C in surface 19 at the aft end of craft 1 would be 7–14 inches for a seventeen foot length craft to provide proper clearance between structure 5 and the water surface for suitable operation of the craft.

It is the purpose of S-shaped bottom surface 19 to provide a venturi chamber between the body structure 5 and the surface of the water upon which the craft is riding which will raise the craft 1 partially onto the water surface and increase its stability. As is well known in the field of aerodynamics, a venturi chamber has a profile which extends from a large frontal opening to a restricted throat portion and then to a large exit area. In the configuration shown in FIG. 2, if the base plane C—C represented the mean surface of the water upon which the craft is riding, the large frontal area would be designated by *h*3, the restricted throat portion would be *h*2 and the large exit portion would be *h*1 or *h*0. The Applicant has found that when the craft 1 is propelled through the water, it rises onto the water surface with only the aft portion of the hull running surfaces 7 submerged. Bottom surface 19 remains entirely above the surface. As a result, the water surface corresponds roughly with the base plane C—C to form the above described venturi-type chamber beneath bottom surface 19. The venturi chamber is at least partially enclosed on the sides by the interior surfaces 9 of hulls 2 and 3.

Because of the varying cross-sectional area of the venturi chamber along its length, i.e., beneath bottom surface 19, the air flow through the chamber undergoes various aerodynamic changes which result in varying aerodynamic forces acting upon the bottom surface 19. In particular, the velocity of air flowing beneath bottom surface 19 increases from the front of the craft toward the constriction denoted by $h2$ and then decreases as the air expands into the larger area at $h1$ (see FIG. 2). With these changes in velocity, there are associated various changes in static and dynamic pressures acting beneath bottom surface 19. The Applicant has found that these changes in static and dynamic pressure have two general results. They act to form an air cushion that tends to raise the forward portion of the craft 1 out of the water and they provide more neutral aerodynamic stability to craft 1 to stabilize it and increase its maneuverability. This is because the center of aerodyanmic pressure acting on body structure 5 is closer to the center of gravity of the craft 1.

The operation of craft 1 and the forming of an air cushion beneath surface 19 can be summarized as follows. Under normal operation, the bottom surface 19 of craft 1 is always positioned above the surface of the water upon which the craft is running. Thus, as craft 1 is propelled through the water, air flows through the venturi chamber formed between bottom surface 19 and the surface of the water upon which the craft is supported. As this air passes beneath bottom surface 19, the various aerodynamic forces which are created by the venturi chamber form an air cushion which tends to lift a portion of the craft 1 above the water suface. This force, in combination with the hydroplaning force which is created on the running surface 7 of side hulls 2 and 3, tends to raise the front portion of the craft 1 out of the water reducing the hydrodynamic drag.

As noted above, the S-shaped surface 19 and the venturi chamber which it produces also results in stabilizing aerodynamic moments acting on the craft 1. Prototype tests of the present invention indicate that these moments tend to prevent the front of the craft from pitching up severely at high speeds, as is the case with many conventional high speed water craft, e.g., tunnel boats. It is believed that this stability results from movement of the center of pressure on bottom surface 19 rearwardly toward the center of gravity (not shown) of craft 1. Thus, it is believed that the pitching moment produced by the pressure on the elevated bottom surface 19 which tends to pitch the front portion of the craft 1 upwardly is reduced. This stabilizing effect allows the craft 1 to be operated safely and to be more accurately controlled and maneuvered at high speeds. Thus, in essence, the present invention provides a two-mode operating water craft. The twin hulls 2 and 3 provide hydrodynamic forces which tend to lift the craft out of the water and reduce hydrodynamic drag. In addition, the aerodynamic body structure 5 produces aerodynamic forces which also tend to lift the craft out of the water and reduce hydrodynamic drag while producing aerodynamic forces which tend to stabilize the craft at high speeds. Using the present invention, water craft can be propelled at speeds, in excess of 60 miles per hour, using a conventional outboard motor.

While the preferred embodiment of the present invention utilizes side hulls for hydroplaning purposes and for partially enclosing the sides of the venturi chamber beneath surface 19, aerodynamic S-shaped surface 19 can be utilized with other hulls and other enclosing means. Thus, flexible or removable side curtains or even air curtains could be used in combination with an aerodynamic body structure 5. Also, it is adaptable for use in boats having any one of numerous hull or superstructrue designs and in various size ranges. It could also be utilized on non-boat craft such as towed water craft or implements, or on aircraft water skis or floats.

The water craft 1 can be propelled by any one of several means, including an outboard motor, an inboard motor or a jet-type propulsion system. To increase the efficiency of the propulsion system which is utilized with the craft 1, or with other high speed water craft, the present invention includes a hydrodynamic power pod 4 which is positioned beneath bottom surface 19, between hulls 2 and 3 (see FIG. 1). The hydrodynamic power pod 4 consists of side members 14 and 15, an aft member 16, and a bottom member 13. The power pod aft member 16 is located near the back of hulls 2 and 3 and the bottom member 13 extends from this point forward to approximately the mid longitudinal point of the craft 1. Aft member 16 is generally planar. In the preferred embodiment it slants upwardly and outwardly but other orientations may also be utilized. As is shown is FIG. 1, the side members 14 and 15 have a wedge-shaped profile and the bottom member 13 curves upwardly between the two side members. Side members 14 and 15 angle inwardly toward one another at the front of the pod. Bottom member 13 has a corresponding pointed front portion. This forms a streamlined profile which is pointed at the front and broad at the aft end. While the surfaces 14, 15 and 13 are shown as planar surfaces in the Figures, they also may be curved in various forms where appropriate. In addition, the power pod 4 may be a solid structure or may be a hollow panel structure which is advantageous in providing a streamlined housing for the motor drive apparatus or water screw shaft.

Chines 17 and 18 are shown attached to the base surface 13 of power pod 4 adjacent the side surfaces 14 and 15, respectively. Chines 17 and 18 extend from the pod aft surface to the front edge of the base surface 13. Each of chines 17 and 18 has a triangular cross-section with one edge extending generally perpendicular to bottom member 13. This edge tends to "cut" the water. It is the purpose of chines 17 and 18 to provide lateral stability to the craft 1 by means of the vertically extending chine surface and to streamline the flow of water around the power pod 4.

It is the purpose of power pod 4 to produce an improved hydrodynamic environment beneath the water craft and forward of a point where the craft power source, e.g., motor prop 30, operates submerged. For reasons which are not clearly understood by the Applicant, this power pod has been found to produce a more efficiently running power source. In particular, in the case of an outboard motor pod which is immersed beneath the craft 1 and along the centerline of pod 4, the motor runs more efficiently to propel the craft 1 at a higher speed. It is believed that this advantageous condition may be the result of increased pressure and more desirable streamlining of the water which flows beneath the power pod and into the operating regime of the power source. The aft edge of the power pod base member 13 should coincide with the craft plane line A—A, ± .05 the beam length of the craft. While the embodiment shown in FIG. 2 shows a power pod 4 extending forward from the plane line A—A a distance of approximately one-half the length of the craft, other particular configurations and sizes of power pod 4 may also be utilized where appropriate. In addition, power pod 4 may be used on water craft having various hull or bottom designs to produce the advantageous flow pattern for the craft power source, and need not be restricted to use on aerodynamic body structure 5. It may be constructed as an add-on element which could be affixed to various water craft.

The various design elements of the present invention may be embodied on water craft of various sizes. The Applicant has found that in a craft having an overall length of 17 feet, power pod 4 would be 8.5 feet long, the craft beam would be 7.5 feet measured along plane line A—A and the S-shaped bottom surface 19 would have the profile specified by the dimension designation h and L noted above. The Applicant has found that in the preferred embodiment, the power pod length should be $.5L \pm .1L$, where L is the overall length of the craft 1. In addition, the length of the flat planar area *7a* of hull running surface 7 should be $.5L + .1L, - .2L$.

The superstructure 6 shown in FIG. 3 can have any advantageous shape or form. The attachment means 20, including a cut-out extension on power pod aft member 16, are provided for attaching an outboard motor 30 to the craft 1 as the power source. Other types of attachment means (not shown) may also be utilized where a different type of power source is used for propelling the craft.

What is claimed is:

1. A high-speed water craft, said craft being generally symmetrical about a longitudinal vertical plane extending along the craft centerline, said craft comprising:

a. two symmetrically disposed hulls for supporting the craft on the water without the need for submerged hydrofoils, each of said hulls including a streamlined front portion, exterior and interior side surfaces, and a bottom running surface, said running surfaces having a planar aft portion upon which the craft rides and an upwardly curving streamlined front portion, said aft portions bounded by an outside lateral edge defining a base plane which is generally parallel to and adjacent the water surface when the craft is moving forward;

b. a body structure having a bottom surface carried between said hulls for supporting a superstructure and passenger compartment; and c. said body structure bottom surface having a curved longitudinal profile, each point on said bottom surface being spaced apart from said base plane to form a tunnel-like opening beneath said body structure; said curved surface defining a venturi chamber in the tunnel beneath the craft for creating aerodynamic forces on the craft when it is propelled forward in the water to elevate and stabilize the craft without the need for submerged hydrofoils, said venturi chamber partially enclosed by the interior surfaces of said hulls and the water surface upon which the craft rides; said bottom surface having a generally unbroken forward surface portion which essentially spans the entire distance between said hull interior side surfaces to form a frontal opening into said venturi tunnel, said forward portion being inclined rearwardly and downwardly toward said base plane to form a constricted throat-like opening in said venturi tunnel, said frontal portion adjoining a rearwardly disposed intermediate surface portion which slopes rearwardly and upwardly away from said base plane to form an enlarged expansiontype opening in said venturi tunnel; said intermediate portion adjoining a rearwardly disposed aft surface portion which slopes rearwardly and downwardly toward said base plane; said aft surface portion having an aft edge generally adjoining said hull interior surfaces to form at least one exit opening from said venturi tunnel; said aft edge being positioned above said base plane a distance at least equal to 60% of the distance between said base plane and said forward surface portion at the constricted opening; said venturi tunnel tending to form a cushion of moving air beneath the craft as it is propelled forward for partially elevating it above the water surface and for providing stability to the craft without the need for submerged hydrofoils.

2. The water craft of claim 1 including power means for propelling the craft through the water at high speeds.

3. The water craft of claim 1 wherein the aft planar portion of said hull running surfaces is oblique to said hull side surfaces and slopes downwardly toward the centerline of the craft from said exterior side surface.

4. The water craft of claim 3 including at least one chine attached longitudinally to each of said hull running surfaces to improve the flow characteristics of the water thereabout.

5. The water craft of claim 1 including a power pod positioned beneath said body structure to streamline and compress the water flowing benneath it to increase the hydrodynamic operating characteristics of a power means which may be attached to the craft, said power pod comprising:

a. two opposed side members attached to said body structure, each having a curved outer suface which has a wedge-like longitudinal profile with a pointed front portion and a bottom edge which slopes downwardly from said body structure bottom surface, said side member front portions each curving inwardly toward one another to form a streamlined profile;

b. a bottom surface attached between said side members and generally along said side member bottom edges to form an inclined bottom surface extending from said body structure bottom surface rearwardly to the back edge of said side members, said bottom surface having a streamlined tapered front portion; and c. said power pod bottom surface positioned relative to said body structure bottom surface so as to be partially submerged when said craft is propelled forward.

6. The water craft of claim 5 including at least two chines, each of said chines attached to opposed side portions of said power pod bottom surface to improve the flow characteristics of the water thereabout.

* * * * *